United States Patent [19]

Takahashi et al.

[11] Patent Number: 5,026,272

[45] Date of Patent: Jun. 25, 1991

[54] COMBUSTION CONTROL DEVICE

[75] Inventors: Masato Takahashi, Kamakura; Kazuo Seki, Ebina; Tetsuya Yamada, Fujisawa; Yukuo Morohoshi, Nakai, all of Japan

[73] Assignee: Yamatake-Honeywell Co., Ltd., Tokyo, Japan

[21] Appl. No.: 356,203

[22] Filed: May 23, 1989

[30] Foreign Application Priority Data

Jun. 3, 1988 [JP] Japan ..... 63-136829

[51] Int. Cl.[5] ..... F23N 5/00

[52] U.S. Cl. ..... 431/79; 431/78; 340/578

[58] Field of Search ..... 431/79, 12, 78; 340/578

[56] References Cited

U.S. PATENT DOCUMENTS 3,344,302 9/1967 Engh et al. ..... 313/100
3,372,279 3/1968 Engh et al. ..... 250/83.6
3,428,901 2/1969 Blackett ..... 328/1
4,043,742 8/1977 Egans et al. ..... 431/79 X
4,435,149 3/1984 Astheimer ..... 431/79 X

*Primary Examiner*—Carl D. Price
*Attorney, Agent, or Firm*—Colucci & Umans

[57] ABSTRACT

A combustion control device capable of detecting a self-discharge state caused by a failure of an ultraviolet ray detecting tube by interrupting flames from a combustion mechanism to an ultraviolet ray detecting tube by opening and closing a shutter, integrating, by an integrating circuit, detection signals from this ultraviolet ray detecting tube only when the shutter is closed, comparing the result of this integration with a preset judgement level by use of a first judgement circuit, and determining a failure by comparing a result of this comparison with a preset failure judgement frequency by use of a second judgement circuit, thereby improving maintainability.

4 Claims, 6 Drawing Sheets

FLAME DETECTING CIRCUIT
5
DISCHARGE DRIVING CIRCUIT
6
FLAME CURRENT DETECTING CIRCUIT
7
COMBUSTION CONTROL MEANS
8
SHUTTER DRIVING CIRCUIT
9
INTEGRATING CIRCUIT
10
1ST JUDGEMENT CIRCUIT
11
JUDGEMENT LEVEL So
12
2ND JUDGEMENT CIRCUIT
13
FAILURE JUDGEMENT FREQUENCY y
14
BURNER
1
2
3
4
VFL
Sn
So
VO1
y
VI
VSH
FAILURE OUTPUT

FLAME DETECTING CIRCUIT
5
DISCHARGE TUBE DRIVING CIRCUIT
6
FLAME CURRENT DETECTING CIRCUIT
7
COMBUSTION CONTROL MEANS
8
SHUTTER DRIVING CIRCUIT
9
INTEGRATING CIRCUIT
10
1ST JUDGEMENT CIRCUIT
11
JUDGEMENT LEVEL So
12
ADDING CIRCUIT
15
BURNER
1
2
3
4
VFL
S'
(S=S+S')
So
VII
VSH
FAILURE OUTPUT

COMBUSTION CONTROL DEVICE

BACKGROUND OF THE INVENTION

1. Field of the Invention

The present invention relates to a combustion control device and, more particularly, to a combustion control device of this kind which is adapted to detect flames from a combustion means mounted in a combustion chamber and control the combustion of the combustion means in accordance with a flame detection signal from a flame detecting means.

2. Description of the Prior Art

Conventional combustion control devices employ an ultraviolet ray detecting tube for detecting the ultraviolet rays emitted from flames as a flame detecting means.

FIGS. 1 and 2 are longitudinal sectional views respectively showing the above-mentioned ultraviolet ray detecting tube. The ultraviolet ray detecting tube shown in FIG. 1 is a glass tube 31 filled with a specific gas, in which a cathode 32 and an anode 33 are provided. Across these two electrodes is applied a voltage from an external power source (not illustrated).

When ultraviolet rays generated from flames are emitted, during the application of the voltage, photoelectrons released from the cathode 32 collide against gas molecules in the glass tube 31, repeating ionization to redouble the amount of gas. Thus the discharge current flows from the cathode 32 to the anode 33, thereby detecting the presence of flames.

An ultraviolet ray detecting tube shown in FIG. 2 is a glass tube 31 filled with a specific gas, in which the cathode 32 and the anode 33 are contained. The cathode 32 and the anode 33 are both provided with a flat electrode plate 34 and a reticulate electrode plate 35 which are disposed opposite to each other. The voltage is applied across the cathode 32 and the anode 33; flame detection is done in a similar manner as the ultraviolet ray detecting tube of FIG. 1.

The combustion control device of prior art constructed as described above has such a problem that when a self-discharge of electricity is caused by a fault or deterioration of the ultraviolet ray detecting tube, a signal indicating the presence of flames is generated even if flames do not exit and therefore no ultraviolet rays are detected (pseudo flame state), thus presenting a trouble. Specifically, since the self-discharge of the ultraviolet ray detecting tube cannot be distinguished from the discharge caused by the presence of flame, it is impossible to find out such defective condition of the tube. Conventionally, the combustion control device is safely stopped when the tube is detected to be broken, thereby presenting a problem that the above-mentioned defective tube is overlooked and cannot be found.

SUMMARY OF THE INVENTION

The present invention has been accomplished in an attempt to solve the above-mentioned problems, and has as an object the provision of a combustion control device capable of early finding out trouble, thereby improving maintainability.

According to one aspect of the present invention for the accomplishment of the aforementioned object, a combustion control device is obtained that has a shutter disposed between a combustion means and an ultraviolet ray detecting tube, a shutter driving circuit which controls the opening and closing operation of this shutter, an integrating circuit which integrates flame signals only when the shutter is in a closed position, a first judgement circuit which compares the result of integration by the integrating circuit with a preset level of judgement, and a second judgement circuit which compares the result of judgement made by the first judgement circuit with the preset number of fault judegements.

Other objects and advantages of the present invention will become apparent from the following description of the embodiment of the present invention, together with the accompanying drawings.

PREFERRED EMBODIMENT OF THE INVENTION

Figure 3:
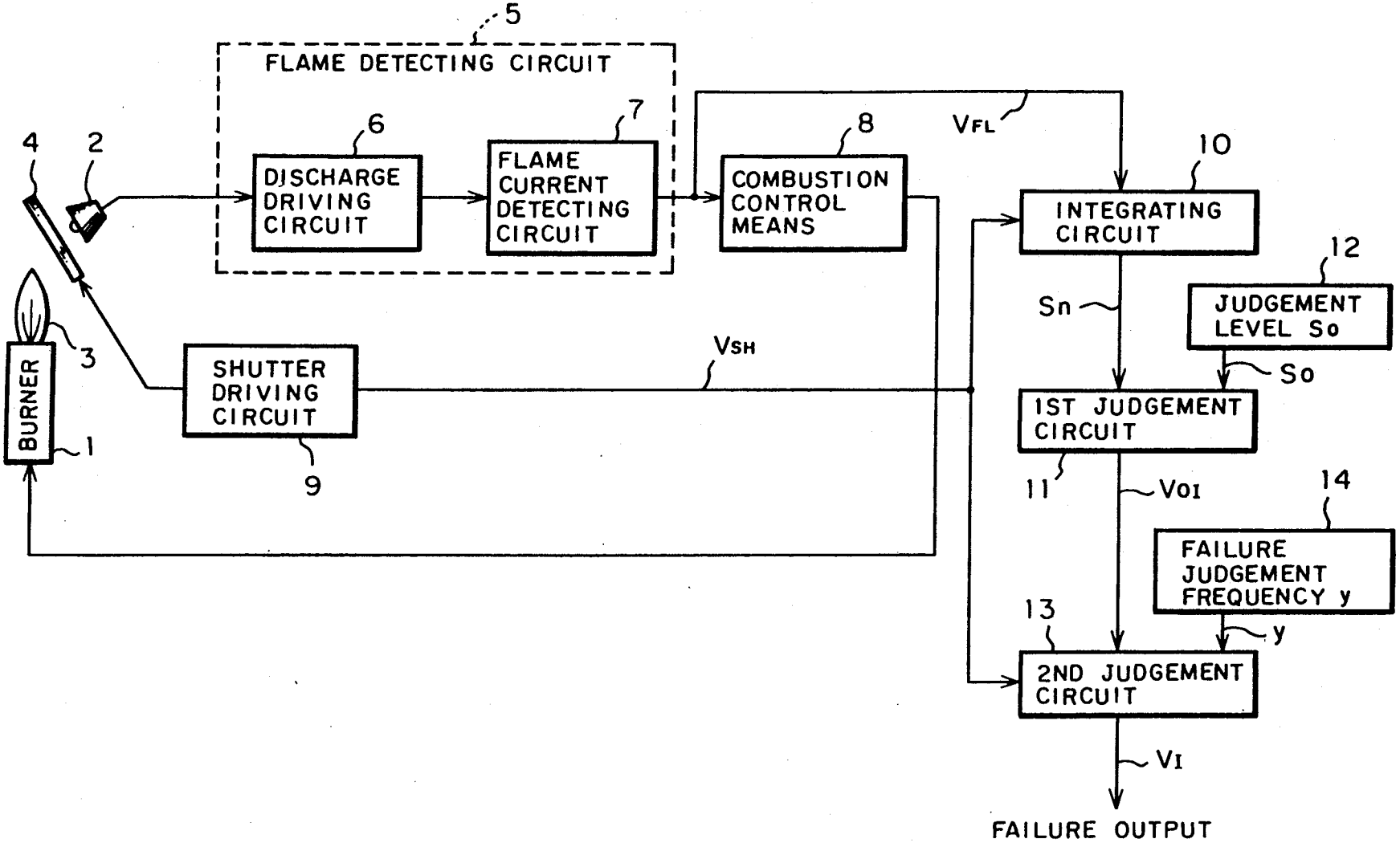
FIG. 3 is a block diagram showing a combustion control device according to one embodiment of the present invention.

A preferred embodiment of the present invention will now be described by referring to the accompanying drawings. In FIG. 3, numeral 1 denotes a burner as a combustion means, numeral 2 an ultraviolet ray detecting tube which detects flames 3, numeral 4 a shutter disposed between the burner 1 and the ultraviolet ray detecting tube 2, and numeral 5 a flame detection circuit which detects flames in accordance with a detection signal inputted from the ultraviolet ray detecting tube 2. This flame detection circuit 5 comprises a driving circuit 6 of the ultraviolet ray detecting tube 2 and a flame current detection circuit 7.

Numeral 8 indicates a combustion control means for controlling the burner 1, numeral 9 a shutter driving circuit for opening and closing the shutter 4, numeral 10 an integrating circuit which integrates an output signal $V_{FL}$ from the flame detection circuit 5 only when the shutter is closed, numeral 11 a first judgement circuit which compares an output signal Sn (n=1, 2, . . . ) of the integrating circuit 10 with a judgement level so preset by a setting device 12, and numeral 13 a second judgement circuit which compares an output signal $\bar{V}_{01}$ of the first judgement circuit with a failure judgement frequency y preset by a setting device 14.

Figure 4:
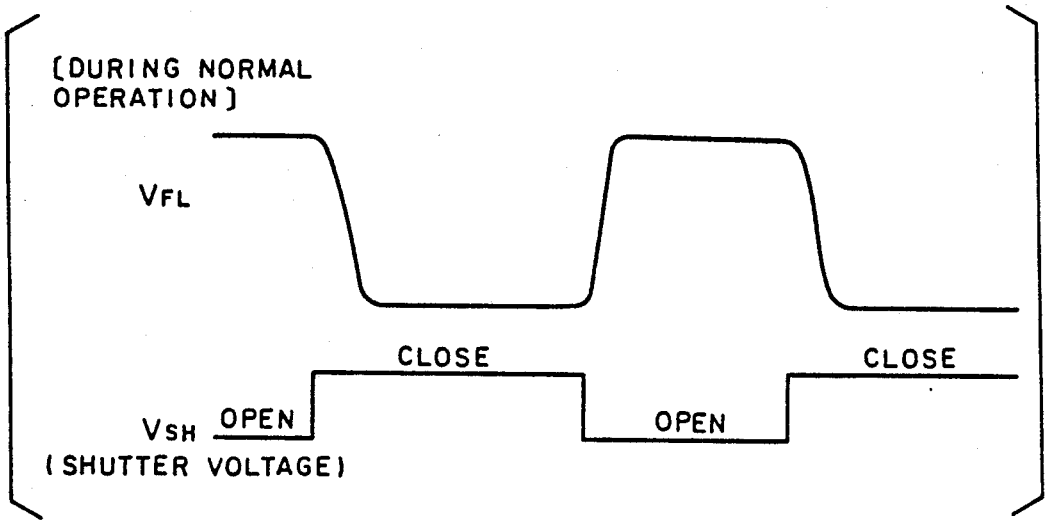
FIG. 4 is a waveform chart showing a relationship of an output signal produced from the flame detecting circuit to the opening and closing of the shutter during normal operation.
Figure 5:
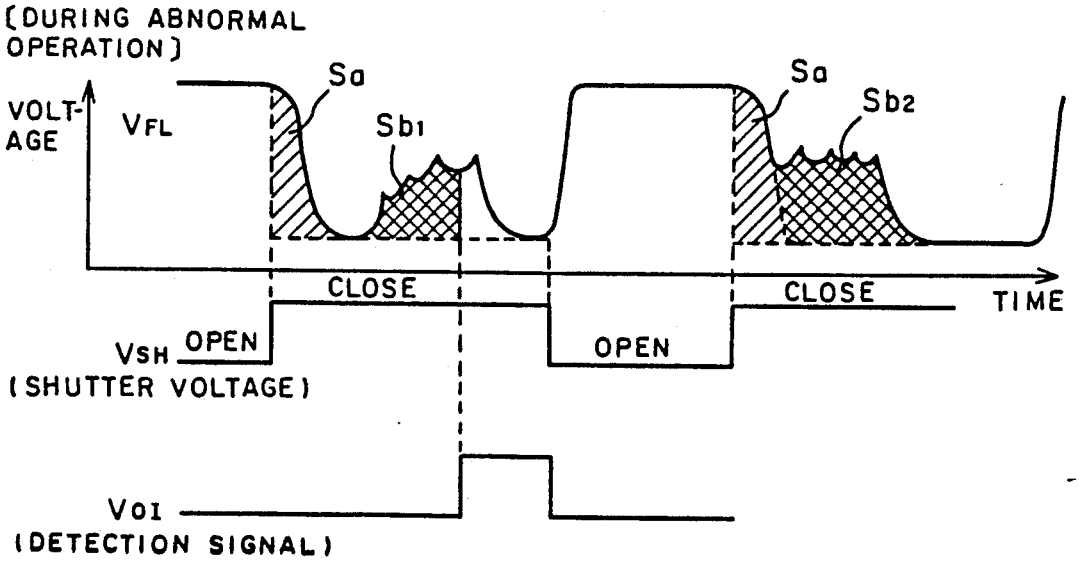
FIG. 5 is a waveform chart showing the same relationship as FIG. 4 during abnormal operation.

FIG. 4 is a waveform chart showing the relationship between the output signal $V_{FL}$ of the flame detection circuit 5 and the opening and closing operation of the shutter during a normal operation. FIG. 5 shows the same relationship during an abnormal operation. In FIGS. 4 and 5, $V_{FL}$ denotes a flame detection signal: $S_1=S_a+S_{b1}$, $S_2+S_{b2}$. $V_{SH}$ is a shutter opening-closing signal, and $V_{01}$ is an output signal produced by the first judgement circuit 11, which is outputted when the output signal $S_n$ exceeds the preset judgement level So. n=1, 2, 3 . . . x, x: a frequency that has been set.

Figure 6:
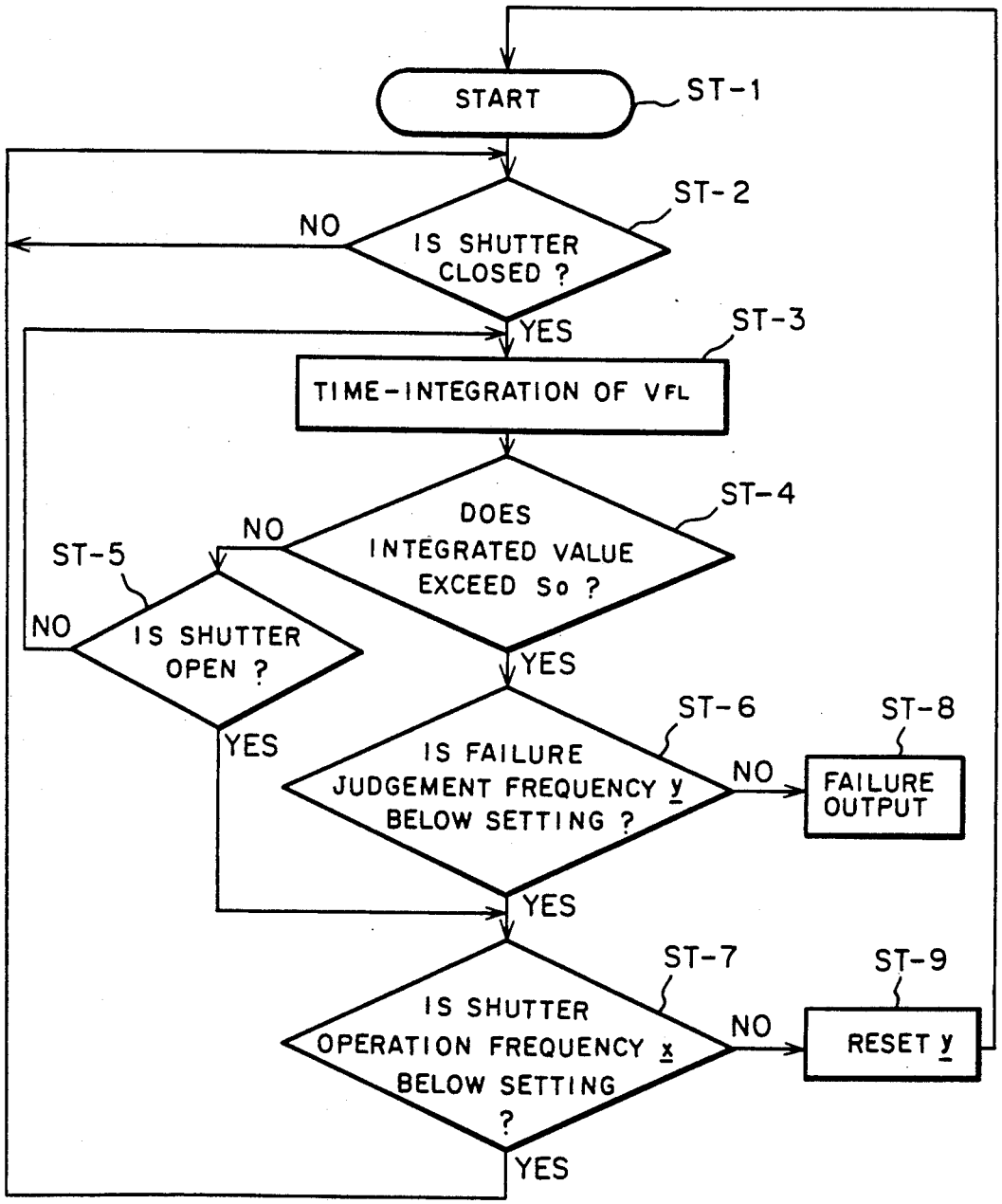
FIG. 6 is a flowchart used for explaining operation.

Next, the operation of the combustion control device will be explained with reference to the flowchart of FIG. 6. With the beginning of a detecting operation at Step ST-1 during normal combustion operation, first it is detected whether the shutter 4 is open or not (Step ST-2). When the shutter 4 is closed, the flame detection circuit 5 outputs a signal $V_{FL}$ which is time-integrated by the integrating circuit 10 (Step ST-3).

Subsequently, a comparison is made by the first judgement circuit 11 (Step ST-4) to determine whether or not the output signal Sn of the integrating circuit 10 exceeds the judgement level So preset by the setting device 12. If the signal Sn is below the level So, it is detected at Step ST-5 whether or not the shutter 4 is open. If the Shutter 4 is not open, the procedure returns to Step ST-3.

When the output signal Sn exceeds the judgement level So at Step ST-4, a tentative failure signal is formed and a determination is made at Step ST-6 to whether or not the failure judgement frequency y exceeds the preset value. If the frequency y is below the preset value, the procedure proceeds to Step ST-7, where it is determined whether the shutter operation frequency x is below the preset value. If the frequency x is below the preset value, the procedure returns to Step ST-2.

Figure 7:
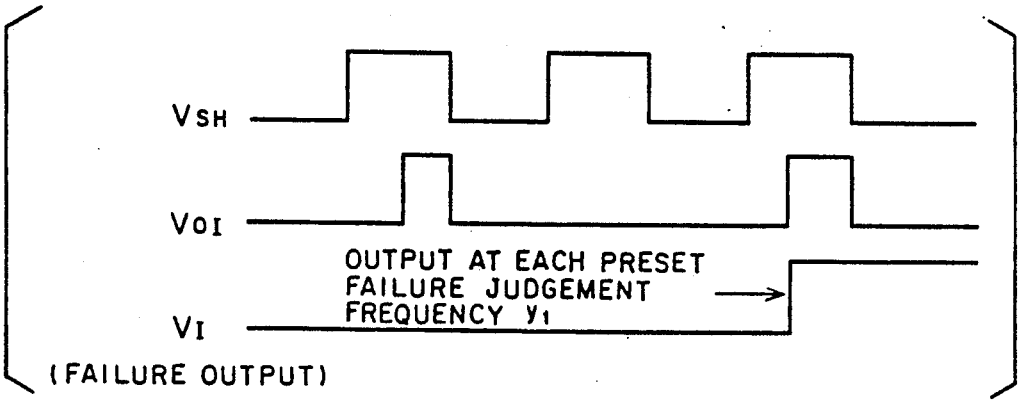
FIG. 7 is a timing chart showing the generation of a defective signal.

If the frequency x exceeds the preset value at Step ST-6, a failure output $V_1$ is outputted as shown in FIG. 7 (Step ST-8). Also, if the frequency x is above the preset value at Step ST-7, the frequency y is reset (Step ST-9), followed by the procedure returning to Step ST-1.

Figure 1:
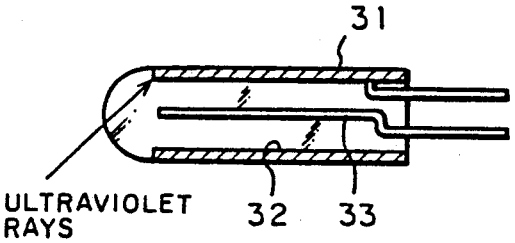
FIG. 1 (PRIOR ART)
FIGS. 1 and 2 are longitudinal sectional views of ultraviolet ray detecting tubes used in prior art combustion controls.
Figure 2:
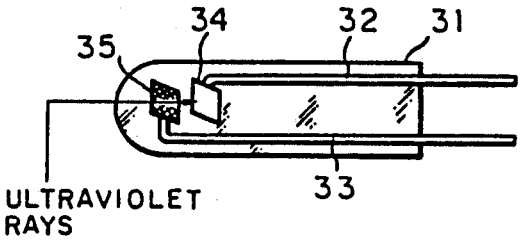
FIG. 2 (PRIOR ART)
Figure 8:
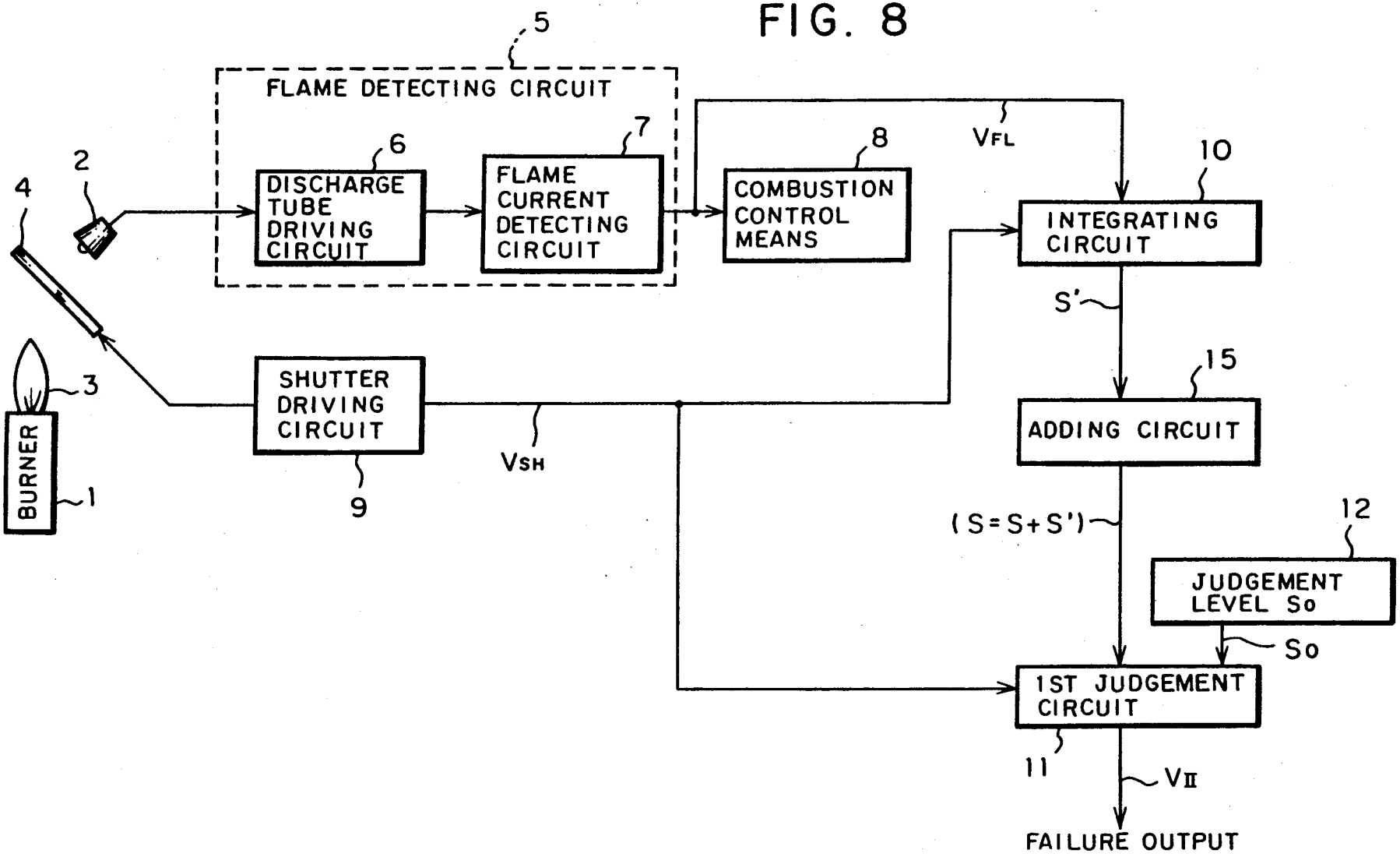
FIG. 8 is a block diagram showing a combustion control device according to another embodiment of the present invention.

FIG. 8 is a block diagram showing a second embodiment of the present invention, in which the same numerals as those used in FIG. 1 are used to denote the same parts. In FIG. 8, numeral 15 is an addition circuit which adds output signals Sn from the integrating circuit 10. This circuit corresponds to the second judgement circuit 13 in FIG. 3.

Figure 9:
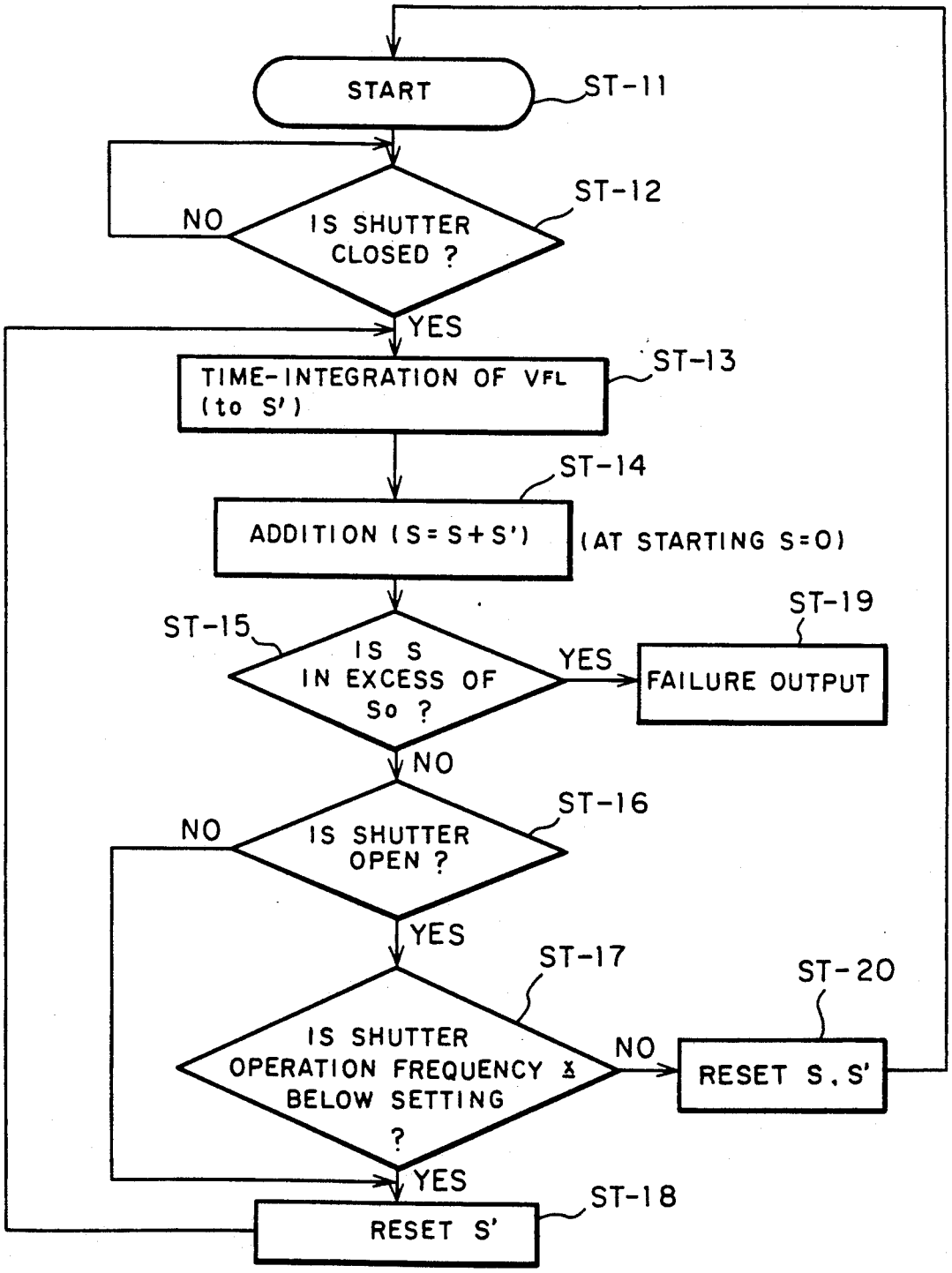
FIG. 9 is a flowchart used for explaining the operation of the embodiment.

Next, operation will be explained by referring to the flowchart of FIG. 9. The operations from the start to the integration (Steps ST-11 to ST-13) are the same as the operations at Steps ST-1 to ST-3 in FIG. 6.

After the addition of the output signals Sn (n=1, 2, . . . ) from the integration circuit 10 by the addition circuit 15 (Step ST-14), a determination is made at Step ST-15 to whether or not the following equation stands:

$$\sum_{n=1}^{x-1} Sn = Sx' > So.$$

When $$\sum_{n=1}^{x-1} Sn + Sx' < So$$

is satisfied a detection is made to whether the shutter is open or not (Step ST-16).

Figure 10:
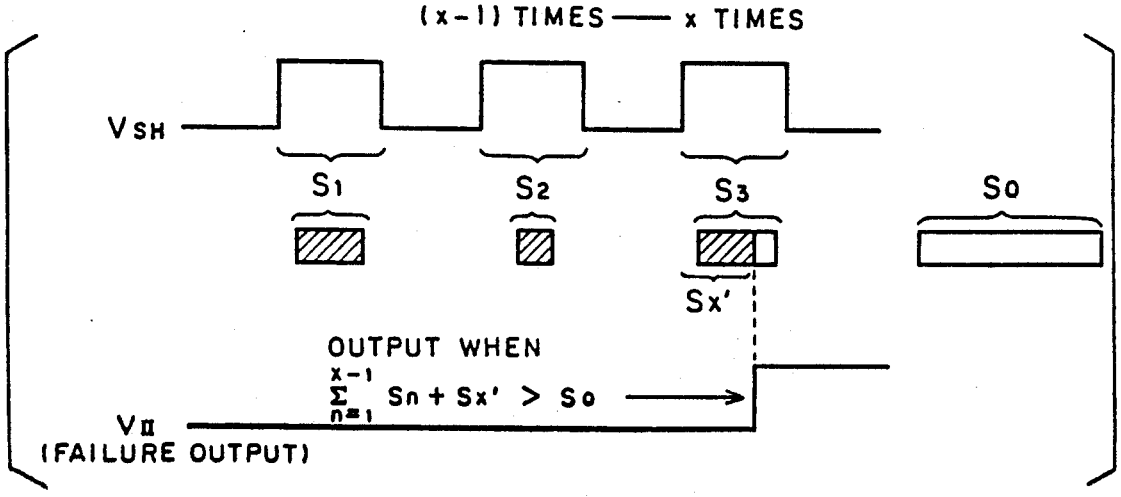
FIG. 10 is a timing chart showing the generation of a defective signal.

When the shutter is open, it is determined at Step ST-17 whether or not the shutter operation frequency x is below the preset value. If the frequency x is below the preset value, the value S' is reset at Step ST-18. Then, the procedure returns to Step ST-13. When it is determined at Step ST-15 that $$\sum_{n-1}^{x-1} Sn + Sx' < So$$

is satisfied, a failure signal $V_1$ will be outputted (Step ST-19) as shown in FIG. 10. Also, if it is determined at Step ST-17 that the shutter operation frequency x exceeds the preset value, S, S' are reset at Step ST-20, and then the procedure returns to Step-11.

According to the present invention, the combustion control device, as described above, is adapted to detecting the presence or absence of a failure by integrating output signals from the flame detection circuit and comparing the number of times the integrated value exceed the judgement level with the failure judgement frequency, or adding the integrated values in order and comparing the result of this addition with a preset judgement level. Therefore, the device can early find out a self-discharge state caused by a failure of the ultraviolet ray detecting tube, thereby producing an effect of improving maintainability. Furthermore, since the circuit construction is simple, the combustion control device according to the present invention can be easily manufactured at a low cost.

What is claimed is:

1. A device for generating a failure signal which indicates failure of flame detecting means for detecting flames generated by combustion means, and for controlling the combustion means, the device comprising:

said flame detecting means generating detection signals when said flame detecting means detects flames generated by the combustion means and when the flame detecting means experiences a failure;

combustion control means connected to said flame detecting means and to the combustion means for controlling the flames of the combustion means in accordance with the detection signals from said flame detecting means;

a shutter for opening and closing between the combustion means and said flame detecting means, for opening and closing access of the flame detecting means to the flames;

a shutter driving circuit connected to said shutter for controlling in the opening and closing of said shutter;

an integrating circuit connected to said flame detecting means for integrating the detection signals only when said shutter is closed;

a first judgement circuit connected to said integrating circuit for comparing the result of an integration of said integrating circuit with a preset judgement level, and, if the result of the integration exceeds the preset judgement level, generating a tentative failure signal; and a second judgement circuit connected to said first judgement circuit for comparing the result of a judgement of said first judgement circuit with a preset failure judgement frequency, and, if the tentative failure signal exceeds the preset failure judgement frequency, generating a failure signal which indicates failure of the flame detecting means.

2. A device as claimed in claim 1, wherein said flame detecting means comprises an ultraviolet ray detecting tube and a flame detecting circuit which detects flames in accordance with detection signals from said ultraviolet ray detecting tube.

3. A combustion control device as claimed in claim 2, wherein said flame detecting circuit comprises a discharge tube driving means and a flame current detecting circuit which receives the output of said discharge tube driving circuit.

4. A device for generating a failure signal which indicates failure of flame detecting means for detecting flames generated by combustion means and for controlling the combustion means, the device comprising:

an ultraviolet ray detecting tube for detecting flames from said combustion means to generate detection signals, said detecting tube forming part of said flame detecting means;

combustion control means connected to said flame detecting means for controlling combustion of said combustion means in accordance with the detection signals from said ultraviolet ray detecting tube;

a shutter for opening and closing between said combustion means and said ultraviolet ray detecting tube for opening and closing access of the detecting tube to flames of the combustion means;

a shutter driving circuit connected to said shutter for controlling the opening and closing of said shutter;

an integrating circuit connected to said flame detecting means for integrating said detecting signals only when said shutter is closed; and an adding circuit connected to said integrating circuit for adding the integrated values and for comparing the added integrated values to a preset judgement level, and, if the added integrated values exceed the preset judgement level, generating a failure signal which indicates failure of the flame detecting means.

* * * * *